US006027190A

United States Patent [19]

Stewart et al.

[11] Patent Number: 6,027,190

[45] Date of Patent: Feb. 22, 2000

[54] HIGH DENSITY LINEAR MOTION STORAGE SYSTEM

[76] Inventors: Edward C. Stewart, 23208 Clocktower Dr., Franklin, Tenn. 37067; C. Allen Stewart, 318 Cotton Ln., Franklin, Tenn. 37069

[21] Appl. No.: 09/012,270

[22] Filed: Jan. 23, 1998

Related U.S. Application Data

[63] Continuation-in-part of application No. 08/524,038, Sep. 7, 1995, abandoned.

[51] Int. Cl.[7] ..... A47B 53/00

[52] U.S. Cl. ..... 312/201; 312/334.27

[58] Field of Search ..... 312/198, 199, 312/201, 295, 319.7, 319.8, 334.29, 334.39, 334.28, 334.24

[56] References Cited

U.S. PATENT DOCUMENTS

| | | | |
|---|---|---|---|
| 463,932 | 11/1891 | Allison | 312/334.28 |
| 2,848,293 | 8/1958 | Jurgens et al. | 312/334.11 |
| 3,544,186 | 12/1970 | Bjorge | 312/334.28 |
| 4,123,126 | 10/1978 | Querengasser | 312/201 |
| 4,559,027 | 12/1985 | Sattel | 474/116 |
| 4,944,231 | 7/1990 | Leist | 104/287 |
| 4,950,123 | 8/1990 | Brockhaus | 414/522 |
| 5,052,878 | 10/1991 | Brockhaus | 414/522 |
| 5,205,627 | 4/1993 | Davison et al. | 312/201 |

FOREIGN PATENT DOCUMENTS

| | | | |
|---|---|---|---|
| 0582775 | 2/1994 | European Pat. Off. | 312/334.28 |

*Primary Examiner*—Peter M. Cuomo
*Assistant Examiner*—Gerald A. Anderson
*Attorney, Agent, or Firm*—Waddey & Patterson; Edward D. Lanquist, Jr.

[57] ABSTRACT

A high density linear storage system comprising at least one storage unit mounted to a base frame assembly. The at least one storage unit may include a plurality of shelves or storage compartments for storing files, books, computer printouts and the like. A handle is mounted on an end of the at least one storage unit to facilitate the extension and retraction of the unit. The base frame assembly includes a stationary base frame and a movable carriage. The carriage further comprises a primary frame and an intermediate frame, which telescopically nest within the base frame when in a fully retracted position. Rollers are attached to the frame members of the intermediate frame and are configured to slidably engage channel members of the base frame and the primary frame. Retaining clips are provided to prevent extension of the primary and intermediate frames beyond a predetermined distance. A locking mechanism prevents the extension of more than one storage unit at a time. A drive system may be provided to assist in the extension and retraction of storage units.

24 Claims, 13 Drawing Sheets

HIGH DENSITY LINEAR MOTION STORAGE SYSTEM

This is a continuation-in-part of application Ser. No. 08/524,038, filed Sep. 7, 1995, now abandoned.

BACKGROUND OF THE INVENTION

The present invention relates generally to storage units, and more particularly to units configured for high density storage, such as those configured for storage of large volumes of files and the like.

Traditionally, four-drawer filing cabinets, such as that disclosed in U.S. Pat. No. 5,251,974, have been used for storing file folders. Filing cabinets are still a popular method of storage; however, the increase in the use of computers in business has resulted in a substantial increase in the amount of paperwork generated on a daily basis. Storage of the additional paperwork has become a problem due to the additional space required for filing cabinets, storage boxes and the like. Increased storage requirements, coupled with the corresponding space requirements for storage and access, have resulted in increased costs for businesses.

Accordingly, it will be appreciated by those skilled in the art that it is desirable to have a system for storing high volumes of files, manuals, books, records and the like, that uses a minimum amount of physical space. To this end, there have been attempts to devise such devices. Open shelving, as disclosed in U.S. Pat. No. 5,127,340, was one of the first products utilized to store large amounts of materials. Unlike traditional filing cabinets, open shelving more effectively utilizes the available vertical space. However, like filing cabinets, open shelving units are stationary and, therefore, require a certain amount of access space between rows.

The power file, as disclosed in U.S. Pat. No. 3,442,564, utilizes vertical space more effectively than open shelving in that shelves are raised and lowered by a motor-driven chain and sprocket system. While these systems have gained popularity, they are extremely costly to maintain.

A rotary file, as disclosed in U.S. Pat. No. 5,312,181, has storage capacity on both the front and back sides. The back side is accessed by pivoting the shelving unit. These units have also gained popularity; however, due to the manner in which files are accessed, they require a significant amount of floor space which usually does not justify the cost.

A lateral slide storage system, as disclose in U.S. Pat. No. 5,205,627, provides high density storage through side-to-side lateral movement of the unit. The unit generally includes two rows of shelving, one in front and one in back. The back row is accessed by sliding part of the front row to the side. These units are generally more cost effective than the aforementioned systems; however, they are limited to a depth of only two rows. Moreover, aisle space in front of the unit is required to access the back row.

Most recently, mobile systems, as disclosed in U.S. Pat. No. 4,944,231, have become the most popular method of high density storage. In this system, open stationary shelves are attached to a movable carriage which rolls with wheels along a stationary track. All the rows of shelving can be rolled together in order to compact the shelving, thus allowing more rows. One drawback associated with this system is that installation of the system is extremely labor-intensive and, thus, costly. Another drawback is that an aisle space within the system must be left open at all times, consuming additional floor space.

U.S. Pat. No. 4,123,126, issued to Querengasser, is directed to a compact shelving apparatus consisting of a cluster of elongated, upstanding stacks of shelves juxtaposed side by side. The shelves are accessible by mounting each elongated stack on an elongated carriage having rear rollers guided in elongated floor tracks coextensive in length and width with the stack and hidden thereunder. Plastic tired wheels are provided under the front of the carriage so that the carriage and stack can be moved endwise on a track out of the cluster to expose the open side shelves. Front shelves may be added to increase storage capacity. A removable crank on the front end, through twist-belt power transmission, advances and retracts each stack. One drawback associated with the Querengasser apparatus is that the wheels on the front end of the carriage may damage the floor or support surface due to the weight of the shelving unit and its contents. Thus, the weight on the wheels may cause undesirable indentations or track marks in the floor due to the extension and retraction of the shelving unit from the cluster.

While the patents referenced hereinabove generally disclose systems for high density storage, each has drawbacks in terms of available storage space, floor space requirements and access requirements. What is needed, then, is a system that enables high density storage while utilizing minimal storage and access space.

SUMMARY OF THE INVENTION

The present invention is directed to a high density linear storage system comprising at least one storage unit mounted on a base frame assembly. The at least one storage unit may include a plurality of shelves or storage compartments for storing files, books, computer printouts and other similar high volume materials. The storage unit is preferably constructed of metal, but may also be constructed of other suitable materials, such as wood and the like. The storage unit is mounted on the base frame assembly such that the ends of the storage unit are perpendicular to a longitudinal axis of the base frame assembly and the stored materials are, therefore, accessible from a side of the storage unit. Thus, the storage units are extendable in an end-to-end direction. The storage unit may include storage space on one side or both sides. A handle is mounted on an end of the storage unit to enable a user to extend and retract the unit.

The base frame assembly is preferably constructed of steel and includes a stationary base frame, which may be anchored to a floor or other support surface, and a movable carriage, which telescopically nests within the base frame when in a fully retracted position and extends to enable access to the stored materials. The base frame comprises a pair of spaced apart channel members and a plurality of supporting crossmembers. The carriage comprises a primary frame and an intermediate frame.

The primary frame comprises a pair of spaced apart channel members and crossmembers. The intermediate frame includes a pair of tubular frame members with rollers mounted on the inner and outer sides. The rollers on the outer side of the frame members are slidably received within the channel members of the base frame. Similarly, the rollers on the inner side of the frame members are slidably received within the channel members of the primary frame. In this manner, the primary and intermediate frames may be telescopically extended from the base frame. Limiting means are provided to prevent extension of the primary and intermediate frames beyond a predetermined distance from their respective supporting frames.

A gang locking mechanism is provided to prevent the extension of more than one storage unit at a time. The locking mechanism operates similar to the locks found on conventional filing cabinet, which prevent the opening of more than one drawer at a time.

It is also contemplated that the storage system of the present invention include a drive system to assist in the extension and retraction of storage units. Thus, a mechanical drive system including a gear assembly, drive rack, and a sprocket and chain assembly may be provided. Alternatively, a electrical drive system including a motor-driven gear assembly and associated controls may be provided.

It is an object of the present invention to provide a high-density storage system that can accommodate various types of shelving and cabinets.

It is an object of the present invention to provide a high-density storage system that provides maximum access to the stored materials while utilizing a minimal amount of floor space.

These and other objects, features and advantages shall become apparent after consideration of the description and drawings set forth herein. All such objects, features and advantages are contemplated to be within the scope of the present invention even though not specifically set forth herein.

DESCRIPTION OF THE PREFERRED EMBODIMENT

Figure 1:
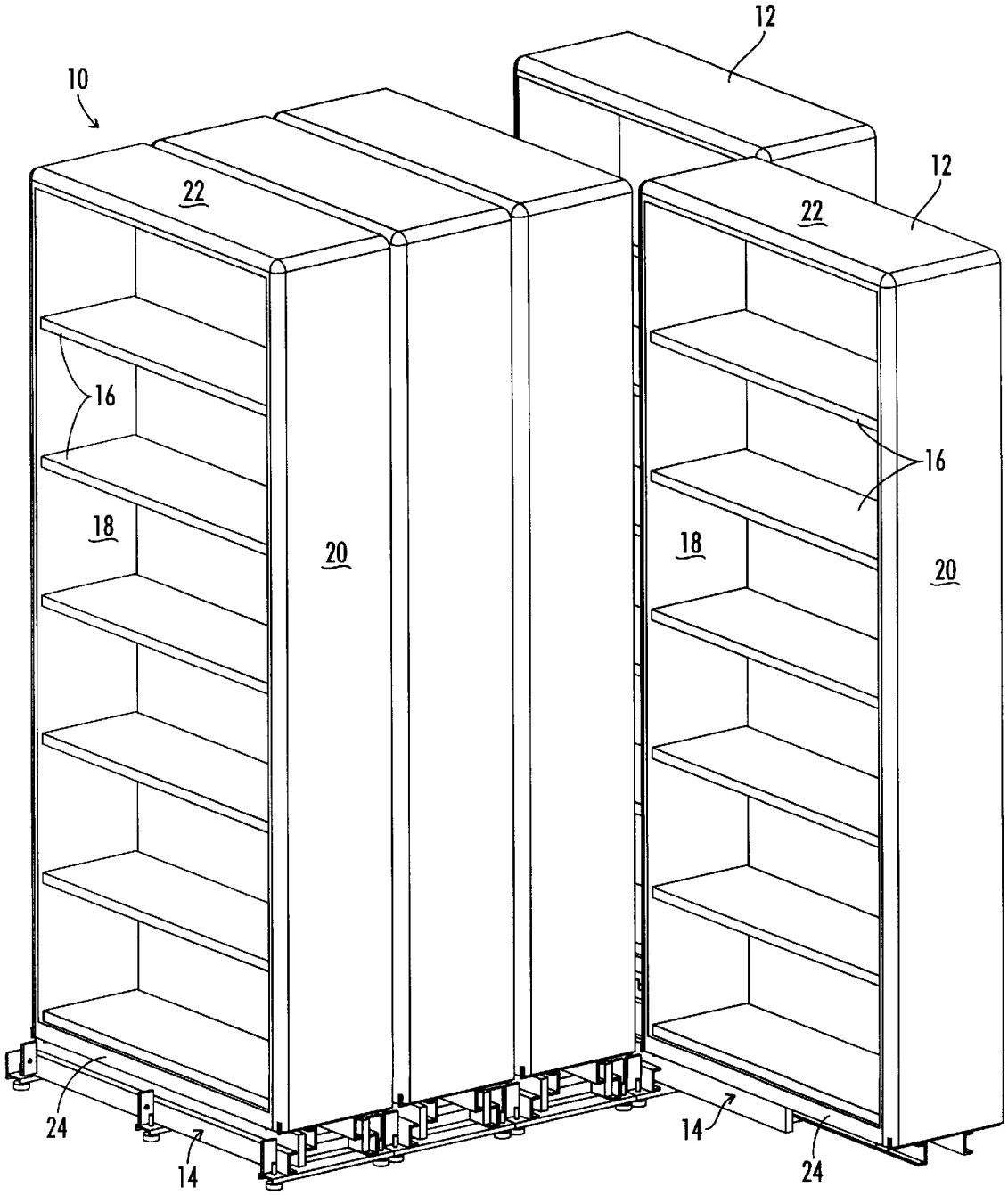
FIG. 1 is a perspective view of the high density linear storage system of the present invention.

An embodiment of the high density linear storage system of the present invention is designated generally by reference numeral 10 in FIG. 1. Storage system 10 comprises at least one storage unit 12 mounted to a base frame assembly 14. Accordingly, the system 10 may include a plurality of adjacent storage units or modules 12 positioned in a side-by-side relationship. Each storage unit 12 is extendable on its base frame assembly 14 to enable full access to items and materials stored therein, and retractable for storage and security of the materials.

Figure 2:
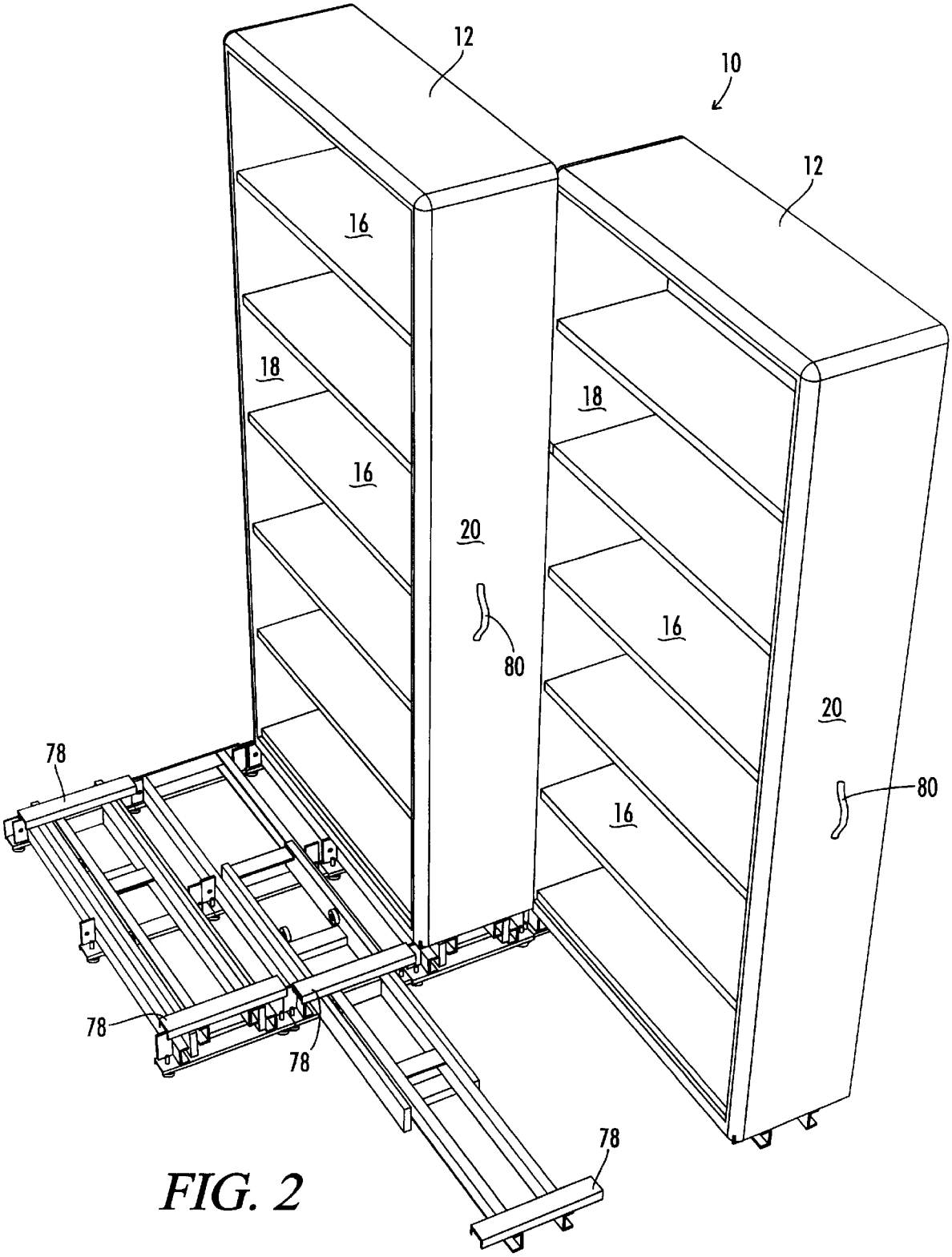
FIG. 2 is a perspective view of the high density linear storage system of the present invention showing the base frame assembly.

With reference to FIGS. 1 and 2, each storage unit 12 generally comprises an upright shelving unit comprising a frame and a plurality or shelves or storage compartments 16. In the preferred embodiment, the frame comprises spaced apart end walls 18 and 20, a top wall 22, a bottom wall 24 and a back wall 26. The shelves 16 are positioned in the frame in parallel spaced relationship in order to accommodate files, books, materials and the like to be stored. Storage unit 12 is configured to enable access to stored materials from an open front side of the unit 12; however, a two-sided storage unit 12 is also contemplated to be within the scope of the present invention. Accordingly, the storage unit 12 may include a plurality of back-to-back opposing shelves or storage compartments 18 separated by a partition or wall so that materials may be stored and accessed on both sides of the unit 12.

Figure 3A:
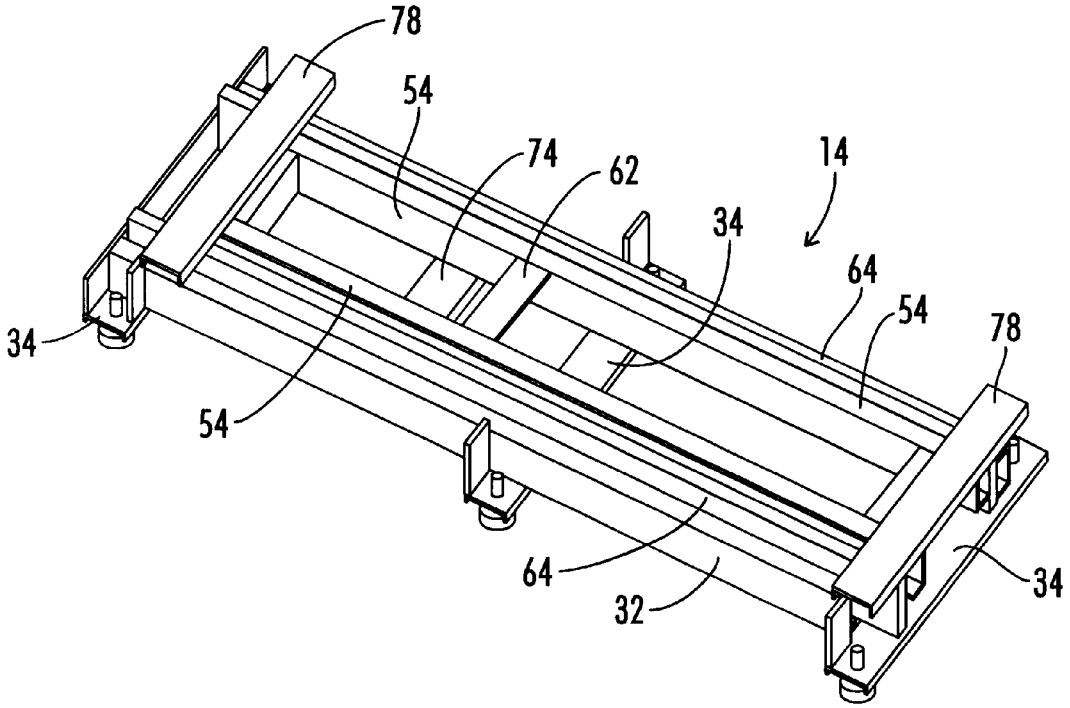
FIG. 3A is a perspective view of the base frame assembly of the present invention shown in a fully retracted position.
Figure 3B:
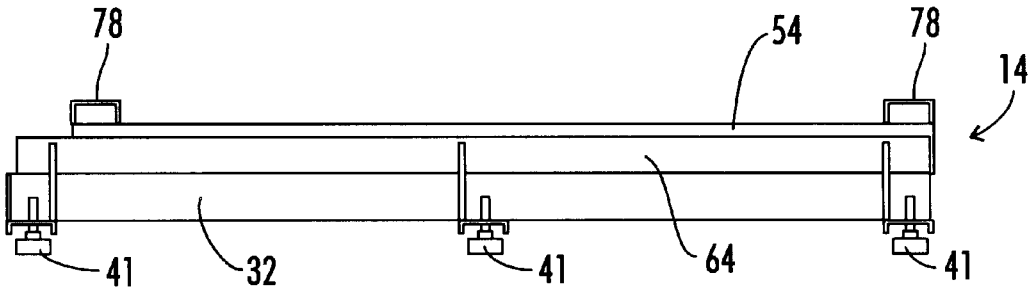
FIG. 3B is a side view of the base frame assembly of the present invention shown in a fully retracted position.
Figure 4A:
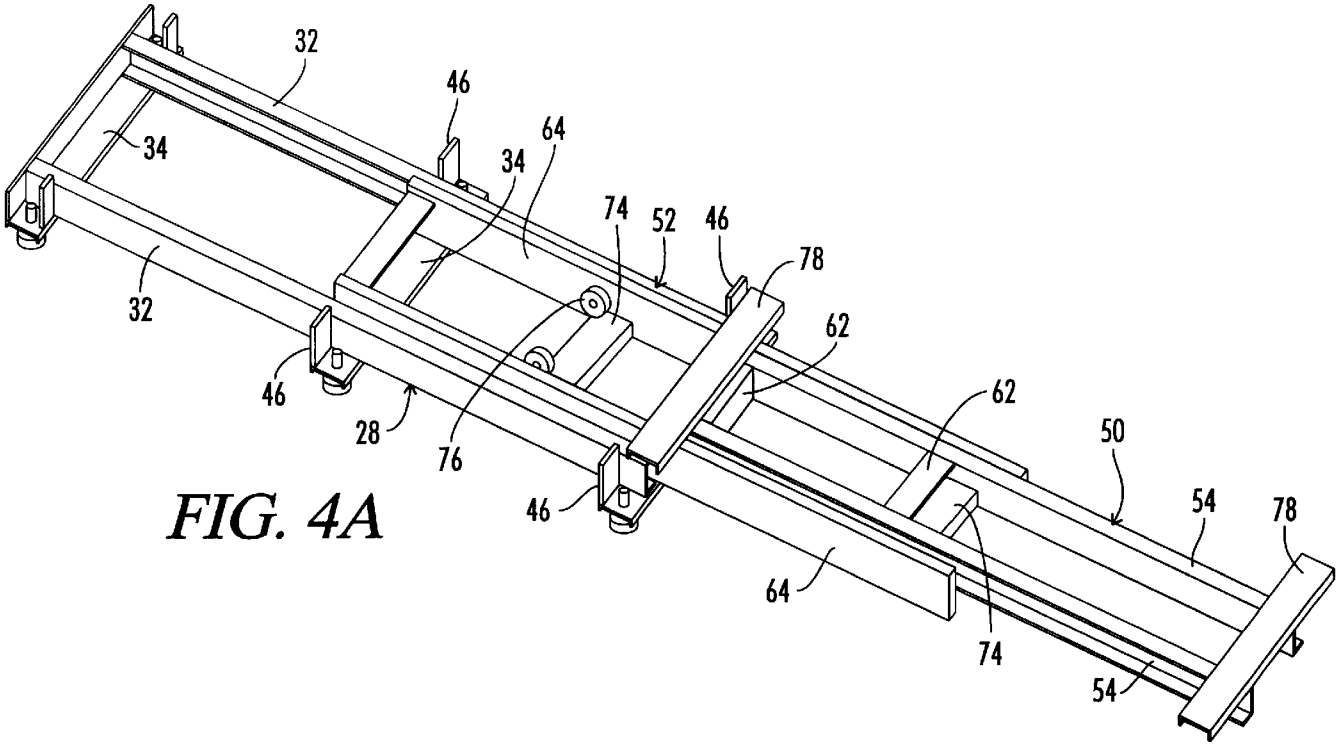
FIG. 4A is a perspective view of the base frame assembly of the present invention shown in a fully extended position.

With reference to FIGS. 3A–3B and 4A–4B, the base frame assembly 14 comprises a plurality of frame or track components which form a stationary base frame 28 and a movable carriage 30. In the preferred embodiment, the stationary base frame 28 comprises a pair of spaced apart, C-shaped channel members 32 connected by a plurality of crossmembers 34 (FIGS. 3A & 4A). The channel members 32 each include an upright leg 36 and opposing top and bottom legs 38 and 40, respectively (see FIG. 5B). The channel members 32 are mounted to the crossmembers 34 such that the open portions of the channel face one another.

Figure 6:
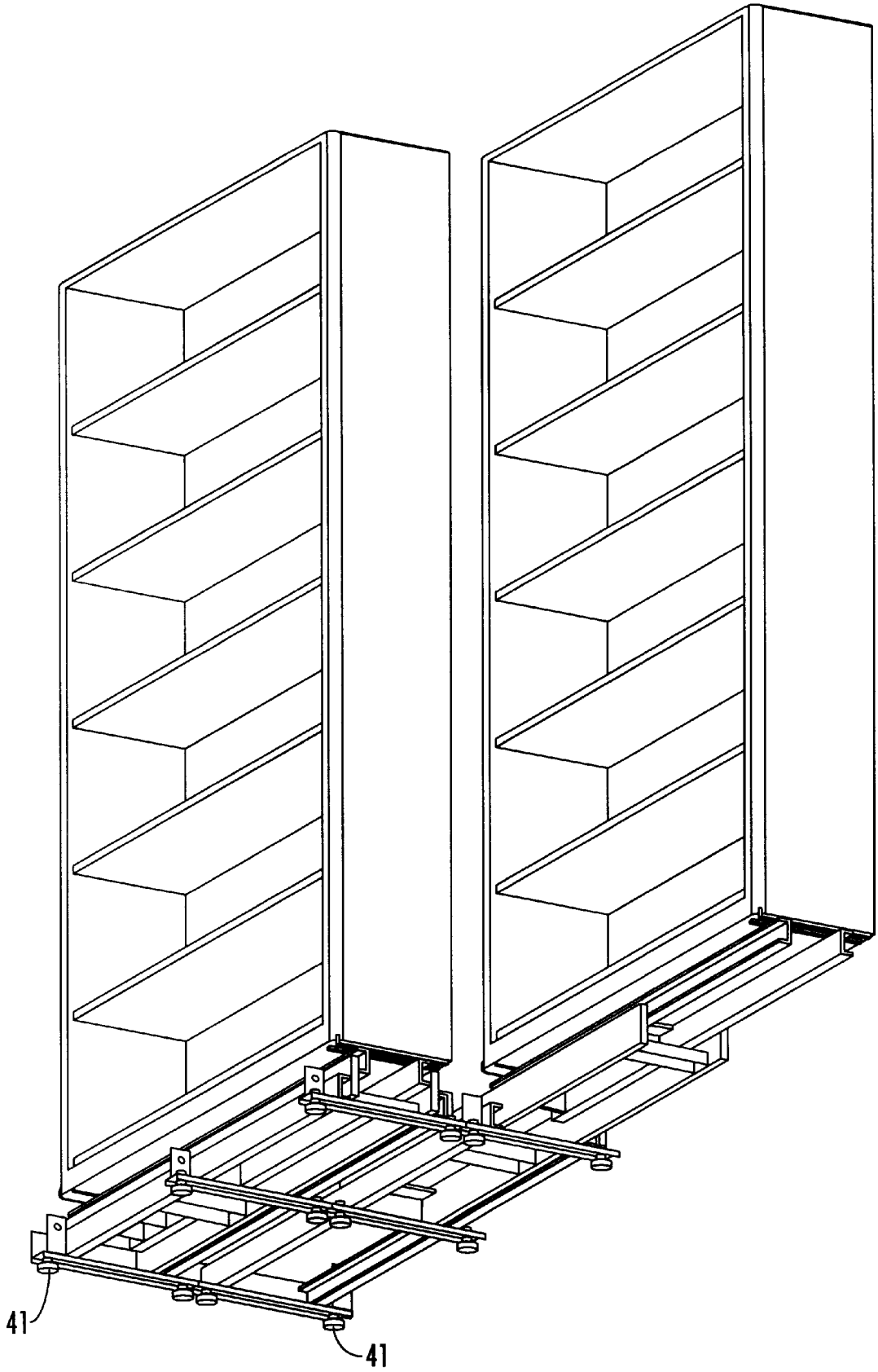
FIG. 6 is a bottom perspective view of a multiple storage unit embodiment of the high density linear storage system of the present invention showing one storage unit in an extended cantilevered position and one storage unit in a fully retracted position.
Figure 7:
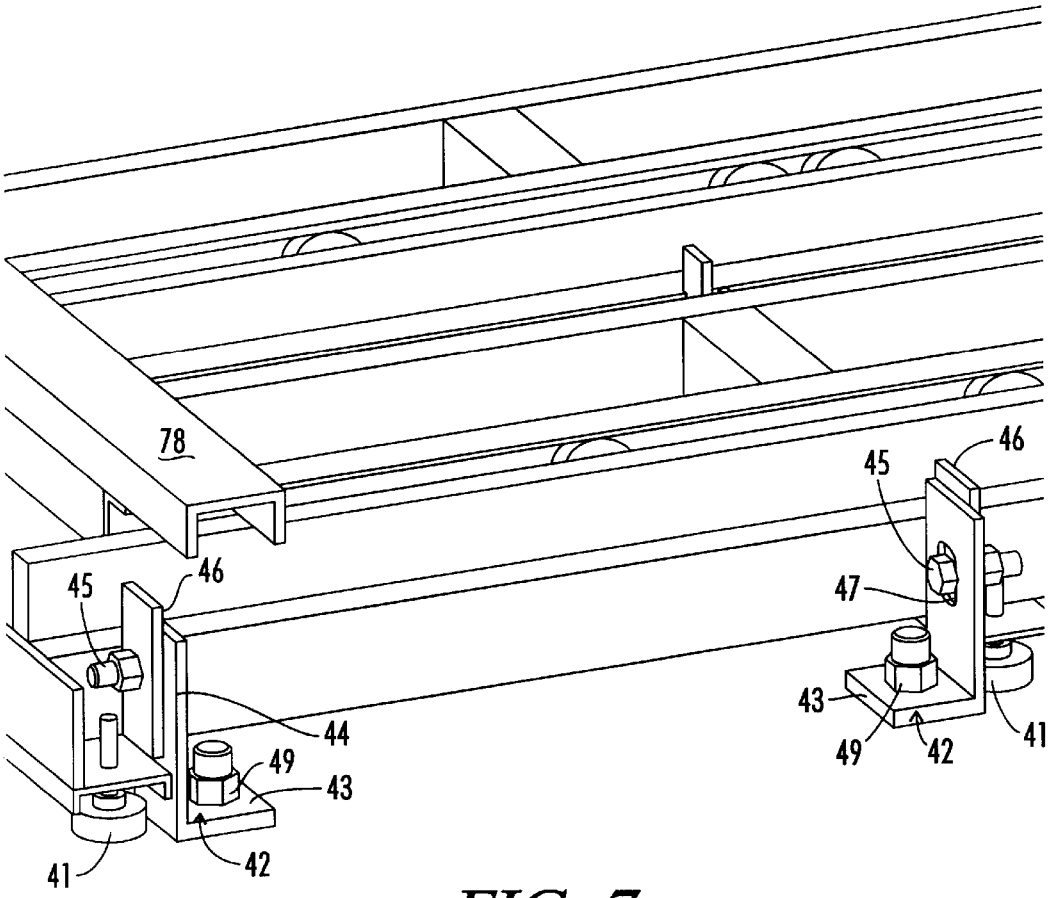
FIG. 7 is a partial perspective view of the base frame assembly of the present invention showing the anchoring flanges and anchoring angles for mounting the base frame to a support surface.

Leveling feet 41 are provided at the corners of the base frame 28, and may be provided intermediate the ends of the channel members 32, to enable the base frame assembly 14 to be leveled on a floor or other support surface (see FIGS. 3B, 4B, 6 & 7). With reference to FIG. 7, anchoring angles 42, each having a base portion 43 and an upright leg portion 44, are adjustably attached with a fastener 45, such as a bolt, to corresponding anchoring flanges 46 rigidly mounted to the base frame 28 to enable the base frame 28 to be anchored to the support surface (FIG. 6). The upright leg portion 44 includes a slot 47 for enabling vertical adjustment of the anchoring angle 42 with respect to the base frame 28. Thus, once the base frame is leveled, the anchoring angle 42 may be adjusted so that the base portion 43 is flush with the support surface. The base portion 43 includes a bore 48 (not shown) configured to receive an anchor bolt or other fastener 49 for anchoring the base frame 28 to the floor or support surface.

Figure 8:
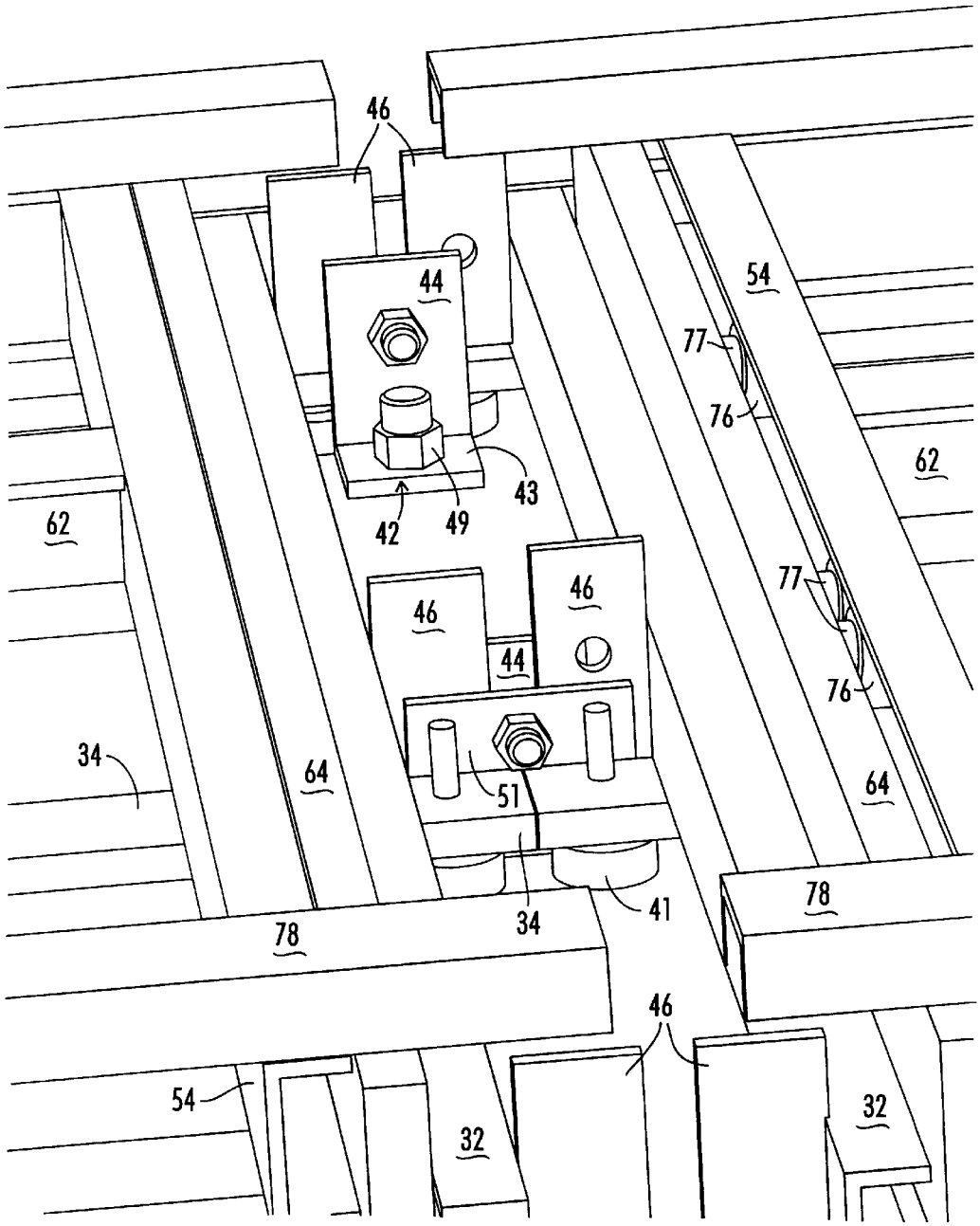
FIG. 8 is a partial perspective view showing the interconnection of adjacent base frame assemblies.

For embodiments that include multiple storage units 12, adjacent base frame assemblies 14 may be attached to one another. With reference to FIG. 8, a pinch plate 51 may be positioned adjacent the anchoring flange 46 opposite the side of the flange adjacent the anchoring angle 42. The pinch plate 51 may be attached to the anchoring angle 42 with a bolt or other suitable fastener. Thus, when the bolt is tightened, the upright leg portion 44 of the anchoring angle 42 and the pinch plate 51 capture the anchoring flanges 46 of adjacent base frame assemblies 14 to hold them in juxtaposition.

Figure 4B:
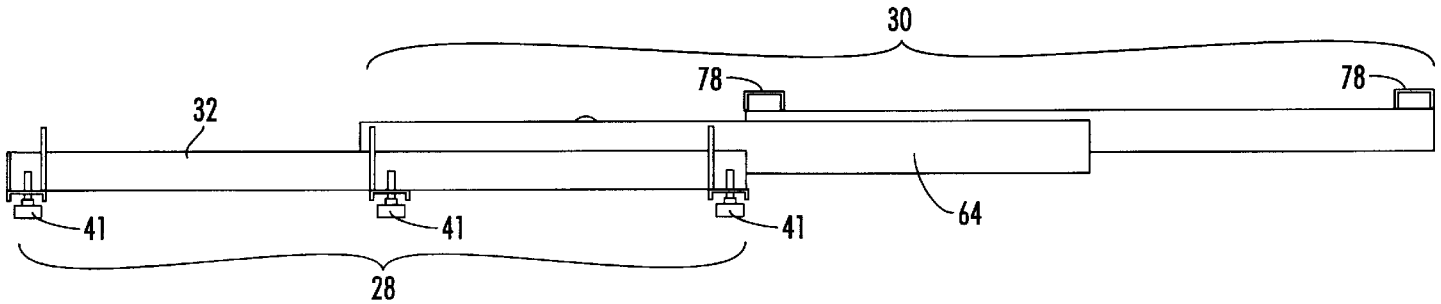
FIG. 4B is a side view of the base frame assembly of the present invention shown in a fully extended position.

With reference to FIGS. 4A and 4B, the carriage 30 comprises a primary frame 50 and an intermediate frame 52 that are slidable with respect to one another and with respect to the base frame 28. The primary frame 50 is telescopically nested within the intermediate frame 52 when fully retracted (FIGS. 3A, 3B & 5A), and cantilevers beyond the intermediate frame 52 when fully extended (FIGS. 4A and 4B). In a like manner, the intermediate frame 52 is telescopically nested within the base frame 28 when fully retracted, and cantilevers beyond the base frame 28 when fully extended. Accordingly, the base frame 28 provides support for the extended intermediate frame 52, and the intermediate frame 50 provides support for the extended primary frame 50. However, the primary and intermediate frames 50 and 52 are not supported at their terminal ends. Rather, the extended primary frame 50 is supported only at the point at which it is operably connected to the intermediate frame 52, and the intermediate frame 52 is supported only at the point at which it is operably connected to the base frame 28. Thus, the extension and retraction of the carriage 30 and the loaded storage unit 12 does not damage the floor or support surface by causing undesirable indentations or track marks because the carriage 30 and storage unit 12 are cantilevered beyond the base frame 28 and do not directly engage the floor or support surface when extended.

Like the base frame 28, the primary frame 50 comprises a pair of spaced apart, C-shaped channel members 54. The channel members 54 each include an upright leg 56 and opposing top and bottom legs 58 and 60, respectively. The primary frame 50 may include one or more crossmembers 62 interposed between the channel members 54. The channel members 54 are positioned such that the open portions of the channel face away from one another.

In the preferred embodiment, the intermediate frame 52 comprises a pair of spaced apart tubular frame members 64, each frame member 64 having spaced apart sides 66 and 68, a top 70 and a bottom 72. A plurality of crossmembers 74 are mounted perpendicularly between the frame members 64 for added rigidity and strength. Support rollers or bearings 76 are rotatably mounted to bearing pins 77, which are, in turn, mounted to the outer and inner sides 66 and 68 of the frame members 64. The rollers 76 are positioned to slidably engage the channel members 32 of the base frame 28 and the channel members 54 of the primary frame 50 to enable the extension and retraction of the carriage 30. Accordingly, the rollers 76 mounted on the outer side 66 of the frame members 64 slidably engage the bottom leg 40 of the channel members 32 associated with the base frame 28. Similarly, the rollers 76 mounted on the inner side 68 of the frame members 64 slidably engage the bottom leg 60 of the channel members 54 associated with the primary frame 50.

Figure 5A:
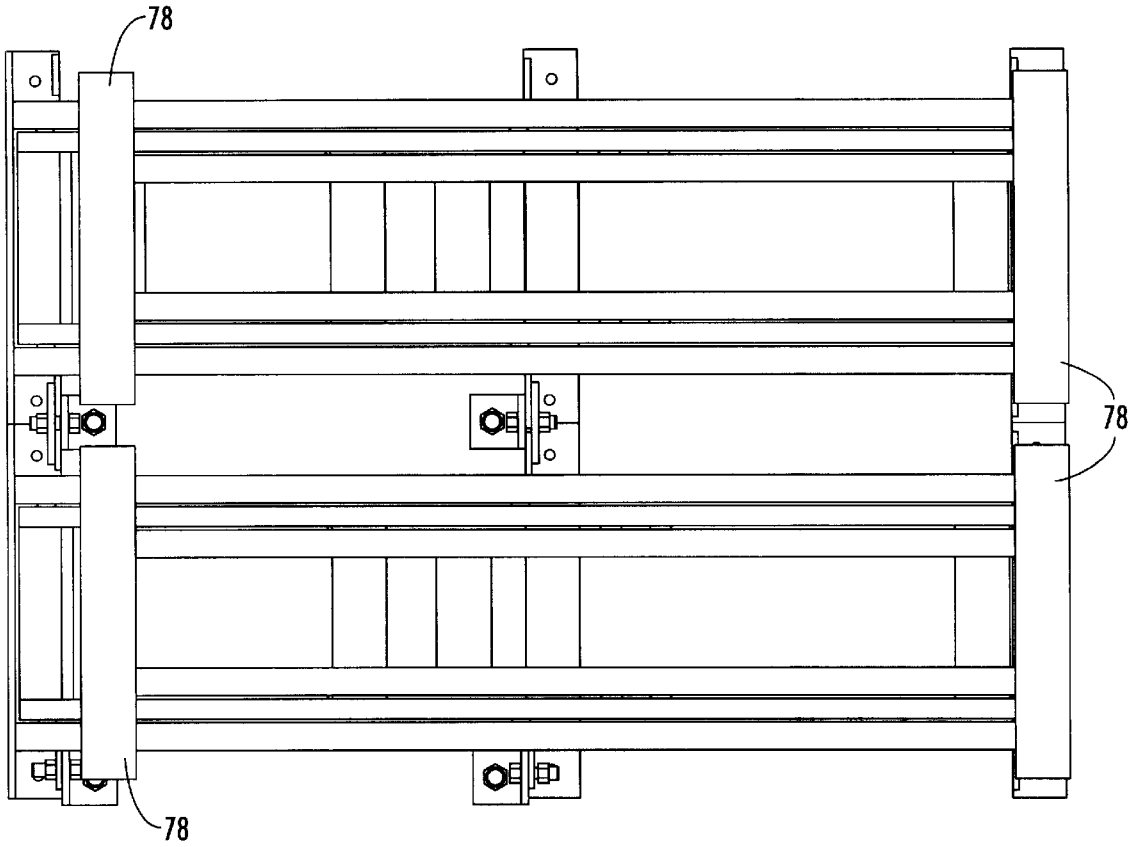
FIG. 5A is a top view of the base frame assembly of the present invention shown in a fully retracted position.
Figure 5B:
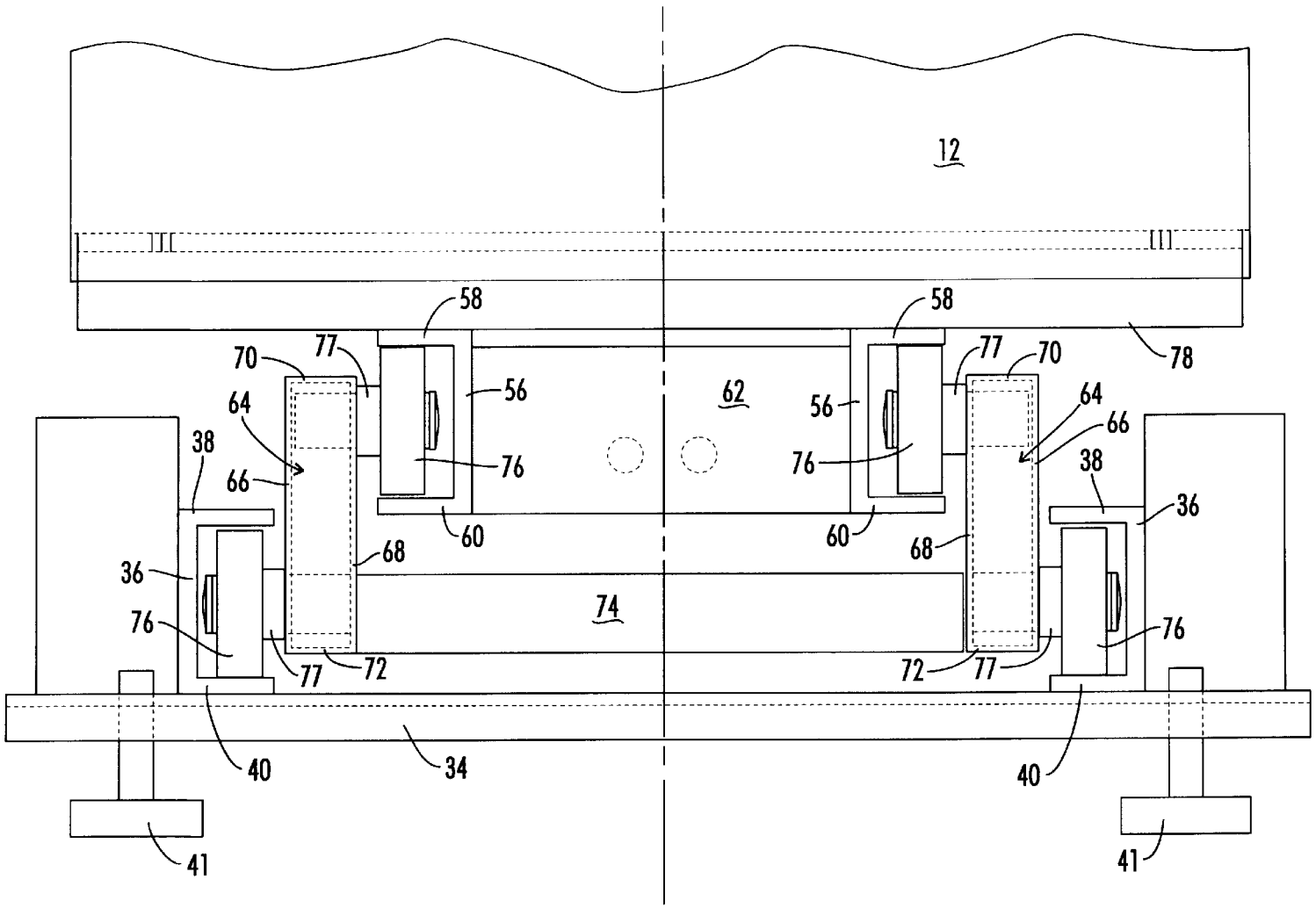
FIG. 5B is an end view of the base frame assembly of the present invention shown in a fully retracted position.

With reference to FIGS. 4A, 5A & 8, support plates 78 for supporting the storage unit 12 are mounted to the carriage 30, preferably perpendicular to the channel members 54 of the primary frame 50 and the tubular frame members 64 of the intermediate frame 52. As shown in FIG. 2, the storage unit 12 is preferably mounted on the carriage 30 such that the end walls 18 and 20 are perpendicular to a longitudinal axis of the base frame assembly 14. Accordingly, the storage unit 12 is movable in an endwise direction with respect to the base frame assembly 14. The storage unit is mounted to the support plates 78 with any type of suitable fasteners, including bolts, self-tapping screws and the like. Handle means 80 are provided to enable the storage unit 12 to be extended and retracted from the base frame 28 in order to access the contents stored therein.

Figure 9A:
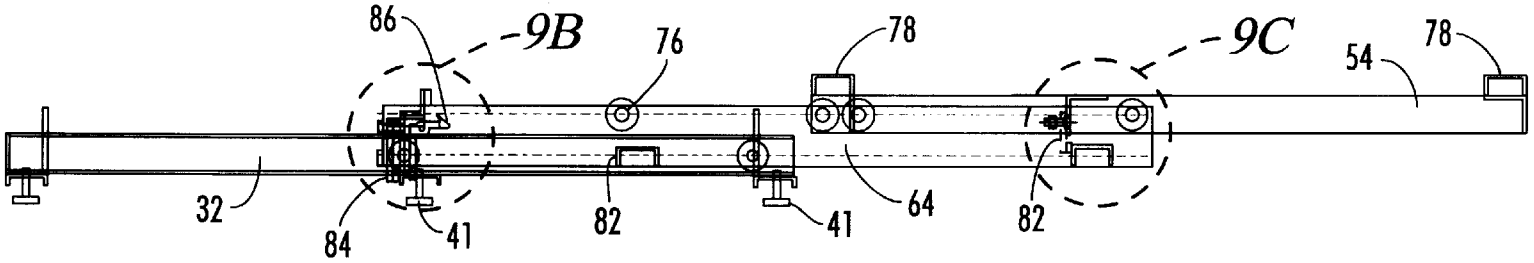
FIG. 9A is a side view showing the stop mechanism for limiting the extension of the intermediate and primary frames.
Figure 9C:
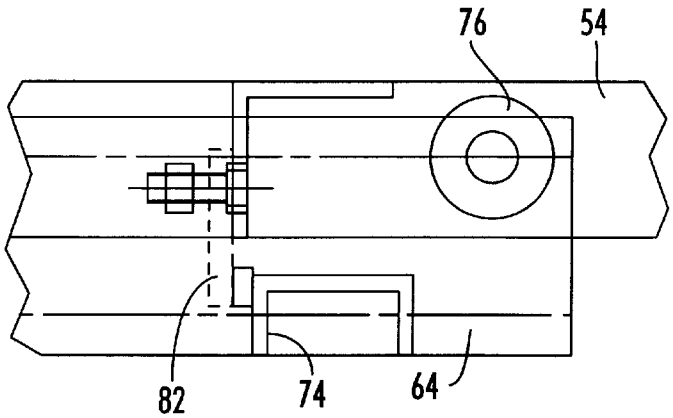
FIG. 9C is a detail view showing the stop mechanism engaging the intermediate frame to limit the extension of the primary frame.

Limiting means are mounted to the primary and intermediate frames 50 and 52, respectively, to limit the range of linear motion of the primary frame 50 with respect to the intermediate frame 52, and to limit the range of linear motion of the intermediate frame 52 with respect to the base frame 28. The limiting means may comprise a stop mechanism 82 mounted to and extending downwardly from the primary frame 50, and a stop mechanism 84 mounted to and extending downwardly from the intermediate frame 52 (see FIGS. 9A–9C). Thus, when the primary frame 50 is extended a predetermined distance, stop mechanism 82 engages a crossmember 74 of the intermediate frame 52 to prevent further extension of the primary frame 50. Likewise, when the intermediate frame 52 is extended a predetermined distance, stop mechanism 84 engages a crossmember 34 of the base frame 28 to prevent further extension of the intermediate frame 52.

Figure 9B:
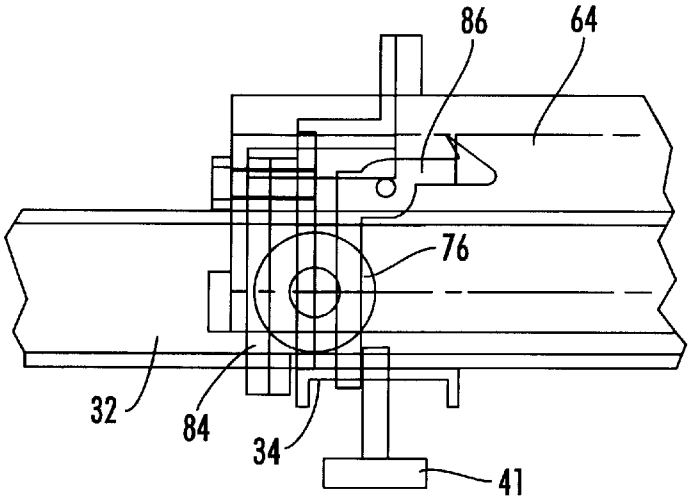
FIG. 9B is a detail view showing the stop mechanism engaging the base frame to limit the extension of the intermediate frame.
Figure 10A:
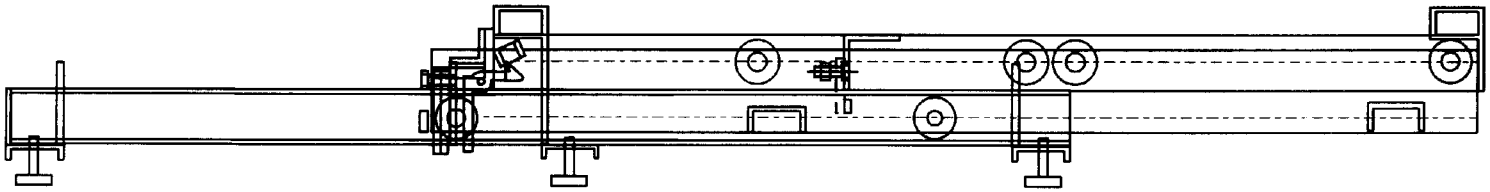
FIG. 10A is a side view showing the latch mechanism for retaining the intermediate and primary frames in a nested configuration during initial extension thereof.
Figure 10B:
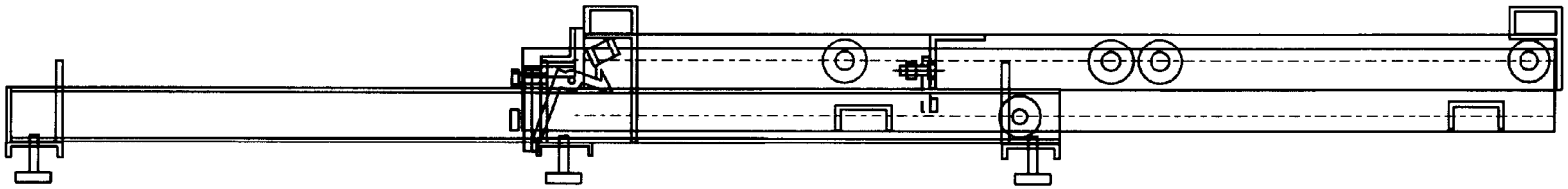
FIG. 10B is a side view showing the latch mechanism beginning to release to enable further extension of the primary frame.
Figure 10C:
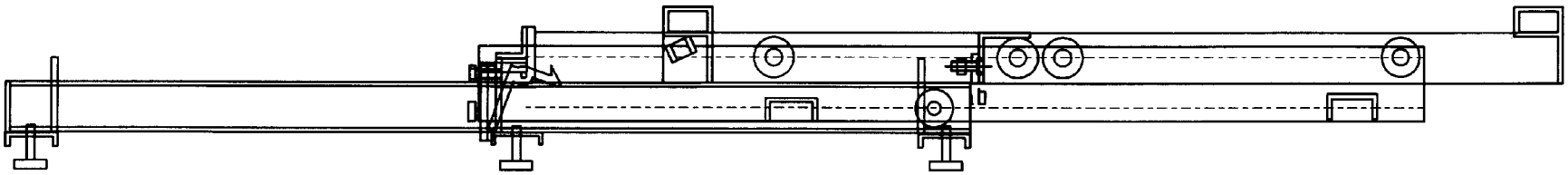
FIG. 10C is a side view showing the latch mechanism fully released and the primary frame extended from the intermediate frame.

With reference to FIG. 9B, a latch mechanism 86 is provided to maintain the primary frame 50 nested within the intermediate frame 52 until the intermediate frame 52 is fully extended. When the intermediate frame 52 is fully extended, a pulling force applied to the storage unit 12 releases the latch mechanism 86 to enable the full extension of the primary frame 50 as shown in FIGS. 10A–10C.

Figure 11A:
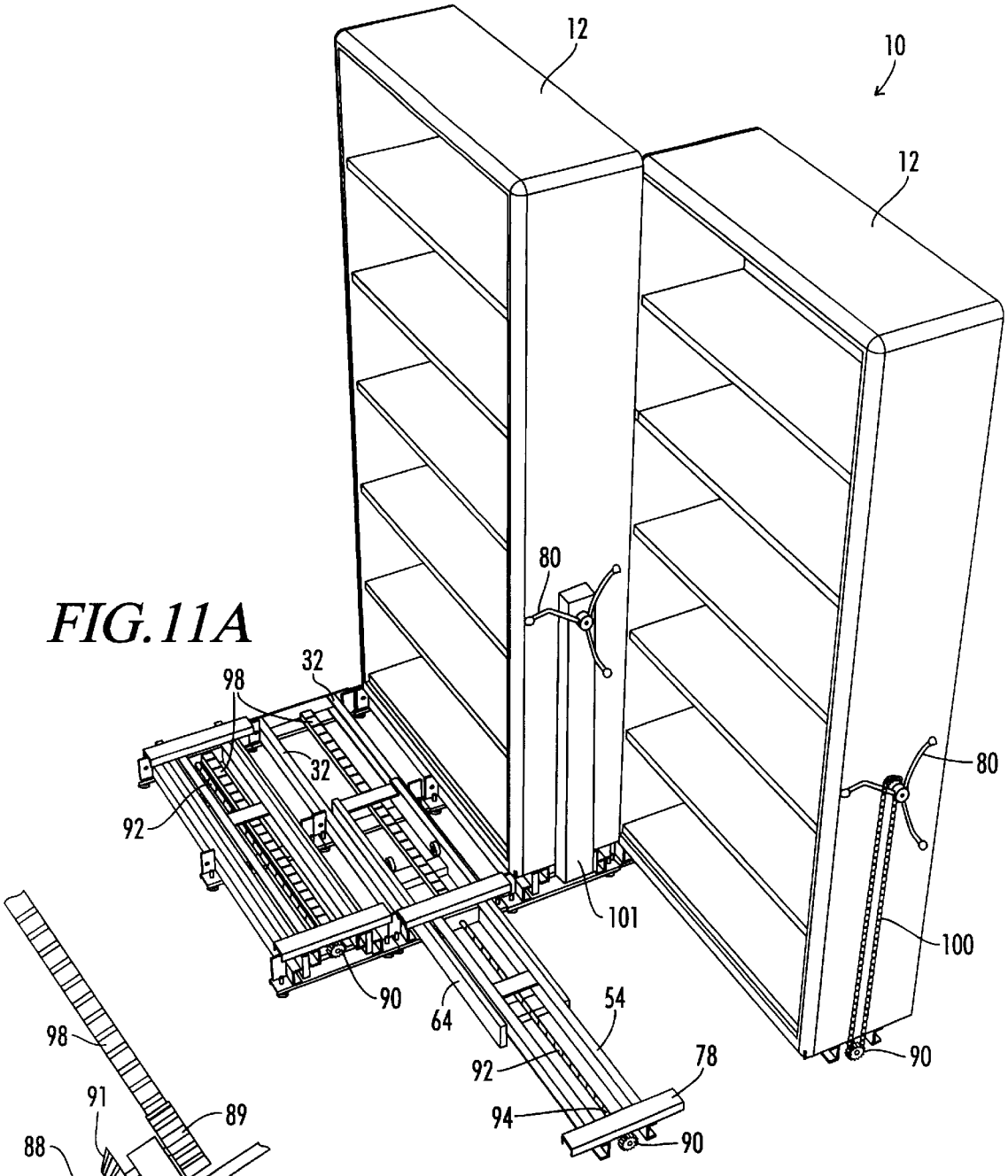
FIG. 11A is a perspective view of the high density storage system of the present invention showing the mechanical assist drive system.
Figure 11B:
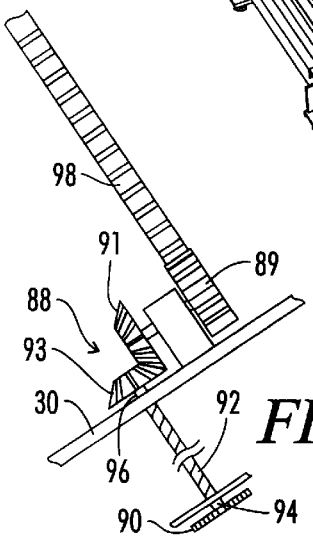
FIG. 11B is a detail perspective view of the mechanical assist drive system of the present invention.

While the storage system 10 described above is manually extended and retracted, it is also contemplated that the system 10 include a mechanical assist or electrical drive system. With reference to FIGS. 11A and 11B, the mechanical assist drive system includes a gear assembly 88 mounted to the carriage 30, a sprocket 90 mounted at the outer end of the primary frame 50, and a shaft 92 having a first end 94 operably attached to the sprocket 90 and a second end 96 operably attached to the gear assembly 88. A drive rack 98 is mounted to the base frame 28 and configured to operably engage the gear assembly 88. A chain 100 operably engages the sprocket 90 and the handle means 80 such that the sprocket 90 rotates in response to rotation of the handle means 80 to extend and retract the storage unit 12. A cover 101 may be provided for the chain 100 and sprocket 90. In the preferred embodiment, the gear assembly 88 includes a drive gear 89 operably connected to a pair of bevel gears 91 and 93, which are, in turn, operably connected to the shaft 92.

Figure 12A:
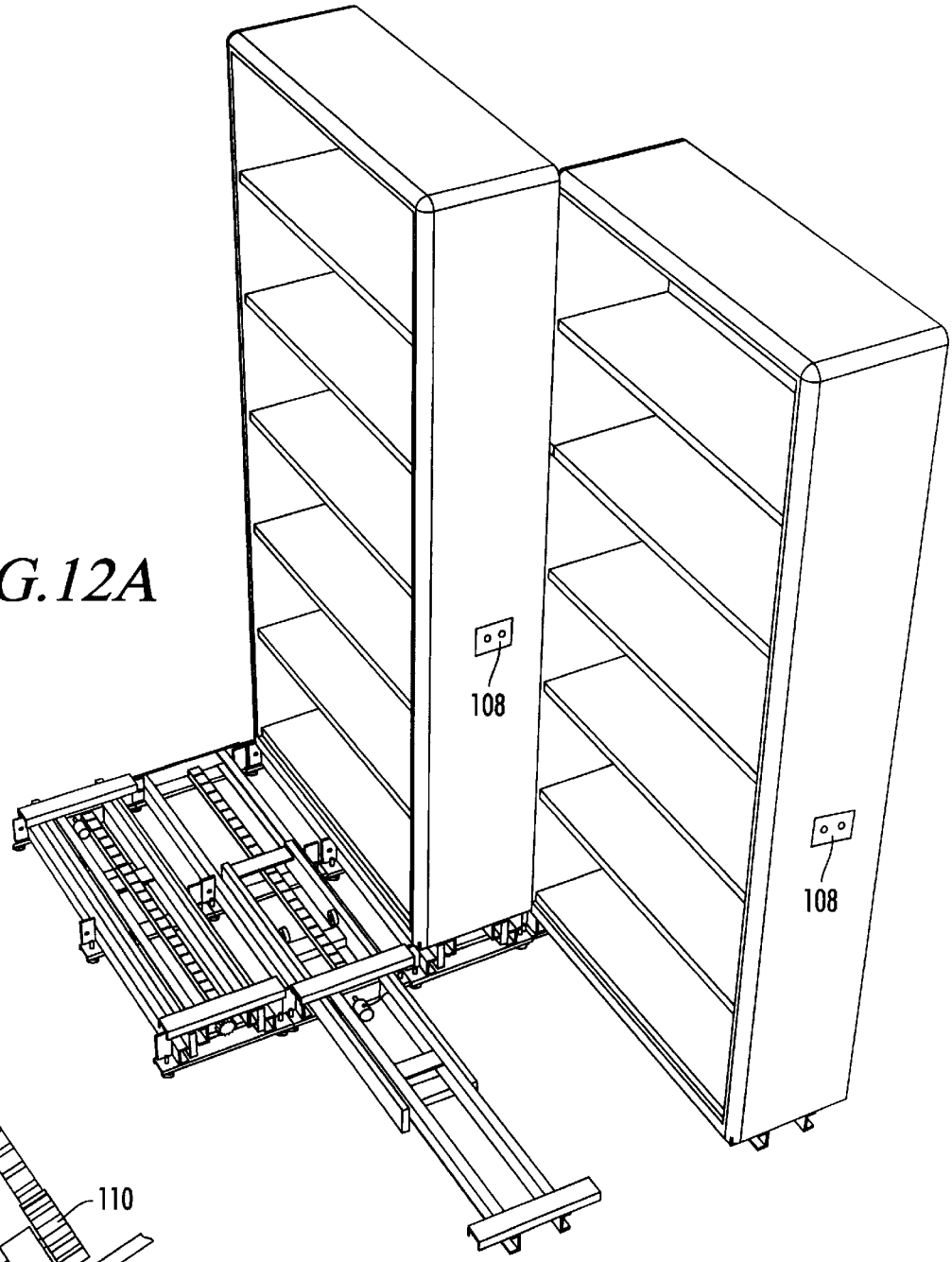
FIG. 12A is a perspective view of the high density storage system of the present invention showing the electrical assist drive system.
Figure 12B:
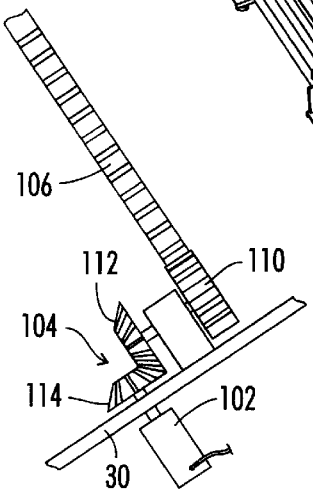
FIG. 12B is a detail perspective view of the electrical assist drive system of the present invention.

With reference to FIGS. 12A and 12B, the electrical drive system includes an electric motor 102 mounted to the carriage 30, a gear assembly 104 mounted to the carriage 30 and operably connected to the motor 102, and a drive rack 106 mounted to the base frame 28 and configured to operably engage the gear assembly 104. In the preferred embodiment, the gear assembly 104 includes a drive gear 110 operably connected to a pair of bevel gears 112 and 114, which are, in turn, operably connected to the motor 102. Control means 108 are provided for actuating the motor 102 in order to extend and retract the carriage 30 in response to the cooperative movement of the drive gear 110 along the drive rack 106.

The high density linear storage system 10 of the present invention further includes a locking mechanism (not shown) to prevent the extension of more than one storage unit 12 at a time. The locking mechanism, therefore, comprises a gang lock that interconnects the plurality of storage units 12 so that when one unit 12 is being accessed, other units 12 in the system 10 may not be accessed. Thus, the locking mechanism operates in substantially the same way as the gang locking mechanism on conventional filing cabinets.

The high density storage system 10 may be housed within a recess formed in a wall or, alternatively, the storage units 12 may include doors or other means for covering the stored materials to prevent unauthorized access thereto.

Thus, although there have been described particular embodiments of the present invention of a new and useful high density storage system, it is not intended that such references be construed as limitations upon the scope of this invention except as set forth in the following claims.

What we claim is:

1. A high density storage system, comprising:

at least one base frame assembly including a stationary base frame and a movable carriage that is slidably operable between an extended position in which the carriage is cantilevered beyond the base frame and a retracted position in which the carriage is telescopically nested within the base frame;

at least one storage unit mounted to and supported by the base frame assembly such that the entire storage unit can be extended and retracted, and the base frame assembly is entirely underneath the storage unit; and handle means attached to the storage unit for extending and retracting the storage unit.

2. The high density storage system of claim 1, further comprising:

means for anchoring the base frame assembly to a support surface.

3. The high density storage system of claim 1, further comprising:

limiting means for limiting the extension of the carriage from the base frame.

4. The high density storage system of claim 1, further comprising:

a plurality of leveling feet.

5. The high density storage system of claim 1, wherein the carriage further comprises:

a primary frame;

an intermediate frame; and roller means in operable communication with the primary frame and the intermediate frame for enabling the slidable extension and retraction of the primary frame with respect to the intermediate frame.

6. The high density storage system of claim 5, further comprising:

drive means for facilitating the extension and retraction of the storage unit.

7. The high density storage system of claim 6, wherein the drive means further comprises:

a gear assembly mounted to the carriage;

a sprocket mounted at a front end of the carriage;

a shaft having a first end operably attached to the sprocket and a second end operably attached to the gear assembly;

a drive rack mounted to the base frame and configured to operably engage the gear assembly; and a chain configured to operably engage the sprocket and the handle means such that the sprocket rotates in response to rotation of the handle means.

8. The high density storage system of claim 6, wherein the drive means further comprises:

an electric motor mounted to the carriage;

a drive gear operably connected to the motor;

a drive rack mounted to the base frame and configured to operably engage the drive gear; and control means for actuating the motor in order to extend and retract the carriage in response to the cooperative movement of the drive gear along the drive rack.

9. A high density storage system comprising:

a base frame;

a movable carriage operably attached to the base frame;

a storage unit mounted to the carriage; and wherein the carriage is operable between a retracted position in which the carriage is nested within the base frame and an extended position in which the carriage is cantilevered beyond the base to enable access to the storage unit; and wherein the carriage further comprises:

a primary frame;

an intermediate frame; and wherein the primary frame is slidably connected to and extendible from the intermediate frame, and the intermediate frame is slidably connected to and extendable from the base frame;

wherein the base frame comprises at least two spaced apart channel members;

the primary frame comprises a pair of spaced apart channel members;

the intermediate frame comprises a pair of tubular frame members having a first set of rollers mounted thereon and positioned to slidably engage the channel members of the base frame, and a second set of rollers mounted thereon and positioned to slidably engage the channel members of the primary frame to enable the extension and retraction of the carriage with respect to the base frame.

10. The high density storage system of claim 9 further comprising:

a housing for enclosing the plurality of storage assemblies to prevent unauthorized access to stored materials when the storage units are in a fully retracted position.

11. A high density storage system, comprising:

a plurality of adjacent storage assemblies, each assembly including a base frame;

a movable carriage operably attached to the base frame;

a storage unit mounted to the carriage such that the base frame is entirely underneath the storage unit; and wherein the carriage is operable between a retracted position in which the carriage is nested within the base frame and an extended position in which the carriage is cantilevered beyond the base to enable access to the storage unit.

12. The high density storage system of claim 11, wherein the carriage further comprises:

a primary frame;

an intermediate frame; and wherein the primary frame is slidably connected to and extendable from the intermediate frame, and the intermediate frame is slidably connected to and extendable from the base frame.

13. The high density storage system of claim 11, further comprising:

a housing for enclosing the plurality of storage assemblies to prevent unauthorized access to stored materials when the storage units are in a fully retracted position.

14. The high density storage system of claim 11, further comprising:

means for connecting the base frame to an adjacent base frame.

15. The high density storage system of claim 14 wherein the locking mechanism further comprises:

a gang lock interconnecting the plurality of storage units to prevent the extension of another storage unit when one of the plurality of storage units is extended.

16. The high density storage system of claim 11, further comprising:

a drive mechanism for facilitating the extension and retraction of the storage assemblies.

17. The high density storage system of claim 11, wherein the storage unit further comprises:

spaced apart end walls, a top wall, a bottom wall, a back wall and a plurality of shelves accessible from at least one side of the storage unit and configured to support stored materials.

18. The high density storage system of claim 17, wherein the storage unit further comprises:

a first storage area accessible from a first side of the storage unit; and a second storage area accessible from a second side of the storage unit, wherein the first and second storage areas are positioned adjacent one another in a back-to-back fashion.

19. A high density storage unit, comprising:

a base frame assembly, including a stationary base and a telescoping carriage assembly;

wherein the carriage assembly further comprises a primary frame and an intermediate frame, and wherein the primary frame is slidably extendable on roller means to a cantilevered position beyond the intermediate frame, and the intermediate frame is slidably extendable on roller means to a cantilevered position beyond the stationary base;

storage means mounted to the carriage assembly for storing a plurality of articles such that the base frame is entirely underneath the storage unit;

wherein the carriage assembly is slidable between a retracted position in which the carriage is nested within the stationary base and the stored articles are inaccessible, and an extended position in which the carriage is cantilevered beyond the stationary base and the stored articles are accessible; and a handle attached to the storage means to facilitate extension and retraction of the storage means.

20. The high density storage unit of claim 19, further comprising:

a releasable latch mechanism for retaining the primary frame in a nested position within the intermediate frame until the intermediate frame is fully extended.

21. A high density storage system, comprising:

at least one base frame assembly including a stationary base frame and a movable carriage that is slidably operable between an extended position in which the carriage is cantilevered beyond the base frame and a retracted position in which the carriage is telescopically nested within the base frame;

at least one storage unit mounted to and supported by the base frame assembly;

handle means attached to the storage unit for extending and retracting the storage unit; and means for anchoring the base frame assembly to a support surface wherein the anchoring means comprises:

at least one anchoring flange rigidly attached to the base frame;

at least one anchoring angle having an upright leg adjustably attached to the anchoring flange and a base leg for engaging the support surface; and fastener means for securing the anchoring angle to the support surface.

22. The high density storage system of claim 21, further comprising:

a plurality of leveling feet.

23. The high density storage system of claim 21, wherein the carriage further comprises:

a primary frame;

an intermediate frame; and roller means in operable communication with the primary frame and the intermediate frame for enabling the slidable extension and retraction of the primary frame with respect to the intermediate frame.

24. The high density storage system of claim 21, further comprising: limiting means for limiting the extension of the carriage from the base frame.

* * * * *